US010044159B1

(12) United States Patent
Page et al.

(10) Patent No.: US 10,044,159 B1
(45) Date of Patent: Aug. 7, 2018

(54) CABLE CONNECTOR CLOCKING DEVICE AND RELATED COMPONENTS

(71) Applicant: Lockheed Martin Corporation, Bethesda, MD (US)

(72) Inventors: Scott T. Page, Keller, TX (US); Karl D. Freyberg, Bedford, TX (US); Lammoon K. Thiphavanthong, Euless, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 367 days.

(21) Appl. No.: 14/720,311

(22) Filed: May 22, 2015

(51) Int. Cl.
*H01R 43/22* (2006.01)
*H01R 43/00* (2006.01)
*H01R 13/71* (2006.01)

(52) U.S. Cl.
CPC ..... *H01R 43/22* (2013.01); *H01R 13/71* (2013.01); *H01R 43/00* (2013.01); *Y10T 29/49169* (2015.01); *Y10T 29/49208* (2015.01); *Y10T 29/49222* (2015.01); *Y10T 29/53252* (2015.01); *Y10T 29/53257* (2015.01)

(58) Field of Classification Search
CPC ..... H01R 43/00; H01R 43/22; H01R 13/71; Y10T 29/49169; Y10T 29/49208; Y10T 29/49222; Y10T 29/53252; Y10T 29/53257
See application file for complete search history.

(56) References Cited

U.S. PATENT DOCUMENTS

2003/0224643 A1* 12/2003 Starta ..... H01R 13/71 439/246
2007/0113398 A1* 5/2007 Jonasson ..... Y10T 29/53257 29/751
2011/0287652 A1* 11/2011 Roscizewski ..... Y10T 29/49208 439/345

FOREIGN PATENT DOCUMENTS

JP 2011046331 A * 3/2011

OTHER PUBLICATIONS

Author Unknown, "BETA® Backshell Accessory Tools," Product Description, www.dmctools.com/Products/backshell_tools.html, Accessed Dec. 16, 2015, Daniels Manufacturing Corporation, 4 pages.

* cited by examiner

*Primary Examiner* — A. Dexter Tugbang
(74) *Attorney, Agent, or Firm* — Withrow & Terranova, PLLC

(57) ABSTRACT

A cable connector clocking assembly for clocking and torqueing a cable connector. In one example, the clocking assembly has a socket adapter sub-assembly configured to be mounted in an adapter holder sub-assembly. The socket adapter sub-assembly includes a socket portion and an adapter portion having a generally cylindrical body portion connected to the socket portion. The adapter portion also has at least one indicium configured to indicate a clock angle of a cable connector when the cable connector is connected to the socket portion. The clocking assembly also includes an adapter holder sub-assembly comprising a clamp portion and a face portion having a plurality of indicia representative of different clock angles. The clamp portion has an unclamped configuration, wherein the socket sub-assembly can be rotated to a desired clock angle, and a clamped configuration, wherein the socket sub-assembly is securely retained in the clamp portion at the desired clock angle.

19 Claims, 11 Drawing Sheets

CABLE CONNECTOR CLOCKING DEVICE AND RELATED COMPONENTS

TECHNICAL FIELD

The embodiments relate to a cable connector clocking device, and related components, systems, and methods.

BACKGROUND

Many types of cable connectors have connection features, which permit the connector to be mated with a receiver, e.g., an adapter, receiver, or another connector, at a predetermined angle, and which also prevent the connector from being mated at different angles. This ensures that the electrical or other components within the connector are properly aligned with complementary components in the receiver when the connector is mated with the receiver. One common method of assembling cables having integrated connector assemblies includes terminating a cable with a connector and rotating a backshell with respect to the cable and connector (for example, by torqueing the backshell around the cable and connector) to cause the connector to be secured to the cable. However, it may be desirable to terminate the cable such that the connector is at a predetermined angle, i.e., "clock angle," with respect to another component of the cable. For example, it may be desirable to orient the connector such that an elbow or boot assembly extends in a predetermined direction when the connector is mated with a receiver. It may also be desirable for the connector to be rotated to the same angle as a connector on the opposite end of the cable, or at a 180° angle with respect to the connector.

In this regard, FIGS. 1A-1D illustrate a conventional connector assembly 10 according to the prior art. The connector assembly 10 includes a cable connector 12 secured to the end of a cable 14. In this example, the cable 14 is secured to the cable connector 12 through an elbow sub-assembly 16 that is configured to orient the cable 14 at a 90° angle with respect to the cable connector 12. In this example, the cable connector 12 includes a connector body 18 having a plurality of key portions 20 for matingly engaging the cable connector 12 with another component, such as a receiver, socket, adapter, or other connector interface. Included in the key portions 20 is a primary connector clocking key 22 that defines a "clock angle" from the cable connector 12 with respect to the cable 14. As used herein, the term "clock angle" refers to a rotational angle of the cable connector 12 relative to another portion of the cable 14 or the connector assembly 10. For example, the clock angle of the clocking key 22 of the cable connector 12 may be measured in relation to a direction of the elbow sub-assembly 16, the cable 14, or a locational position of a complementary connector or adapter on an opposite end of the cable 14. In this example, using the elbow sub-assembly 16 as a reference, the clocking key 22 of the cable connector 12 may be considered to be at a 12:00 clock angle in the configuration illustrated by FIGS. 1A and 1B. Similarly, the clocking key 22 of the cable connector 12 is rotated to 3:00 clock angle in the configuration illustrated by FIGS. 1C and 1D. In this example, the cable connector 12 is secured at a particular clock angle with respect to the elbow sub-assembly 16 by tightening, or torqueing, a threaded backshell 24, thereby preventing the cable connector 12 from rotating with respect to the elbow sub-assembly 16 or the cable 14.

Accurately and reliably maintaining the cable connector 12 at the correct clock angle during cable assembly can be difficult. In this regard, FIGS. 2A through 2C illustrate a conventional arrangement for setting a clock angle of the connector assembly 10 during assembly. Referring now to FIG. 2A, a conventional socket 26 is illustrated. The socket 26 is configured to matingly engage with the key portions 20 and the clocking key 22 of the cable connector 12 (not shown), in order to retain the cable connector 12 at the correct clock angle during assembly. The socket 26 has a socket body 28 having complementary key portions 29 for mating with the key portions 20 of the cable connector 12 of FIGS. 1A-1D. The socket 26 may also include an external grip surface 30 and a clocking bubble 32. The clocking bubble 32 is oriented such that, when the cable connector 12 is mated with a receiving portion 34 of the socket 26, the clocking bubble 32 is disposed at the same angle as the clocking key 22 of the cable connector 12.

Referring now to FIG. 2B, a conventional table vice clamp 36 is illustrated, with the socket 26 being held therein at a predetermined clocking angle. In this example, the vice clamp 36 includes a pair of vice blocks 38 compressing a pair of jaws 40, which are configured to secure and retain the socket 26 at the predetermined clock angle. In this conventional arrangement, the socket 26 is disposed between the jaws 40 and rotated to a predetermined clock angle, 12:00 in this example. A handle 42 can then be turned to tighten the blocks 38 and the jaws 40 around the socket 26 thereby constraining movement, including rotational movement, of the socket 26. With the vice clamp 36 secured to a suitable base 44, the cable connector 12 can now be connected to the socket 26. Referring now to FIG. 2C, it can be seen that the cable connector 12 is retained at the predetermined clock angle when securing the cable 14 and the elbow sub-assembly 16 to the cable connector 12.

This arrangement has a number of drawbacks, however. First, it is difficult to align the clocking bubble 32 of the socket 26 to a precise clock angle within the jaws 40 of the vice clamp 36. In addition, because the circumference of the grip surface 30 of the socket 26 is relatively small, it is relatively easy for the socket 26 to rotationally slip within the jaws 40 when the backshell 24 is torqued during assembly of the connector assembly 10. In addition, reducing slip of the socket 26 in the jaws 40 may require manually tightening the vice clamp 36 to the point that pain in the hand and wrist may be experienced by a user. Such over-tightening of the vice clamp 36 may also lead to premature wear of the jaws 40. Accordingly, there is a need for an improved cable connector clocking assembly for clocking and torqueing a cable connector.

SUMMARY

Embodiments include a cable connector clocking device for clocking and torqueing a cable connector, and related components, systems, and methods. In one embodiment, the clocking assembly has at least one socket adapter sub-assembly configured to be mounted in an adapter holder sub-assembly. The socket adapter sub-assembly includes a socket portion having a first end and a second end configured to be connected to a cable connector. The socket adapter sub-assembly also includes an adapter portion having a generally cylindrical body portion connected to a second end of the socket portion at a first end of the cylindrical body portion. The adapter portion also has at least one indicium configured to indicate a clock angle of a cable connector when the cable connector is connected to the socket portion. The indicium is proximate to the first end of the cylindrical body portion. The clocking assembly also includes at least one adapter holder sub-assembly comprising a clamp portion configured to receive the adapter portion of the socket adapter sub-assembly, and a face portion. The face portion of the adapter holder sub-assembly has a plurality of indicia representative of different clock angles. When the clamp portion is in an unclamped configuration, the socket adapter sub-assembly can be rotated to align the indicium of the adapter portion with an indicium of the plurality of indicia of the face portion. By aligning the indicium of the adapter portion with one of the indicia of the face portion, the socket portion can be accurately rotated to a desired clock angle. When the clamp portion is in a clamped configuration, the socket adapter sub-assembly is securely retained in the clamp portion at the desired clock angle.

One advantage of this arrangement is that a socket can be accurately and securely positioned at a number of different specific clock angles. By aligning and securing the indicium of the socket adapter sub-assembly to one of the indicia of the adapter holder sub-assembly corresponding with a specific clock angle, it is possible to secure a connector to a cable, e.g., by torqueing, at the correct clock angle with greater precision and fewer defects. In addition, it is also possible to inspect the clock angle of the finished cable while the cable is connected to the socket. By inspecting the alignment of the indicia of the socket adapter sub-assembly and adapter holder sub-assembly, a user can quickly and accurately determine if there was any slippage in the clock angle while the connector was being connected to the cable, e.g., during torqueing.

In one embodiment, a clocking assembly for cable connectors is provided. The clocking assembly comprises at least one socket adapter sub-assembly. The at least one socket adapter sub-assembly comprises a socket portion having a first end and a second end, wherein the first end is configured to be connected to a cable connector. The at least one socket adapter sub-assembly further comprises an adapter portion. The adapter portion comprises a generally cylindrical body portion having a first end and a second end, wherein the second end of the socket portion is connected to the first end of the cylindrical body portion. The at least one socket adapter sub-assembly further comprises at least one indicium proximate to the first end of the cylindrical body portion configured to indicate a clock angle of the cable connector when the cable connector is connected to the socket portion. The clocking assembly further comprises an adapter holder sub-assembly. The adapter holder sub-assembly comprises at least one clamp portion configured to receive the adapter portion of the socket adapter sub-assembly therein. The adapter holder sub-assembly further comprises a face portion having a plurality of indicia indicative of different clock angles. The clamp portion has an unclamped configuration, in which the socket adapter sub-assembly is rotatable to align the indicium of the adapter portion with an indicium of the plurality of indicia of the face portion. The clamp portion also has an unclamped configuration, in which the socket adapter sub-assembly is retained with the indicium of the adapter portion aligned with an indicium of the plurality of indicia of the face portion.

In another embodiment, a socket adapter assembly for a clocking assembly is provided. The socket adapter assembly comprises a socket portion having a first end that is configured to be connected to a cable connector, and a second end. The socket adapter assembly further comprises an adapter portion. The adapter portion comprises a generally cylindrical body portion having a first end and a second end, wherein the second end of the socket portion is connected to the first end of the cylindrical body portion. The adapter portion further comprises at least one indicium proximate to the first end of the cylindrical body portion configured to indicate a clock angle of a cable connector when the cable connector is connected to the socket portion.

In another embodiment, a method of clocking a cable connector is provided. The method comprises disposing a socket adapter sub-assembly in an adapter holder sub-assembly in an unclamped configuration. The method further comprises rotating the socket adapter sub-assembly in the adapter holder sub-assembly to align an indicium of the socket adapter sub-assembly with one of a plurality of indicia of the adapter holder sub-assembly indicative of a predetermined clock angle of a cable connector. The method further comprises connecting a cable connector to the socket adapter sub-assembly such that the cable connector is disposed at the predetermined clock angle. The method further comprises securing the cable connector to a cable at the predetermined clock angle.

Those skilled in the art will appreciate the scope of the disclosure and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The use herein of ordinals in conjunction with an element is solely for distinguishing what might otherwise be similar or identical labels, such as "first terminal" and "second terminal," and does not imply a priority, a type, an importance, or other attribute, unless otherwise stated herein. The term "about" used herein in conjunction with a numeric value means any value that is within a range of ten percent greater than or ten percent less than the numeric value.

Figure 3A:
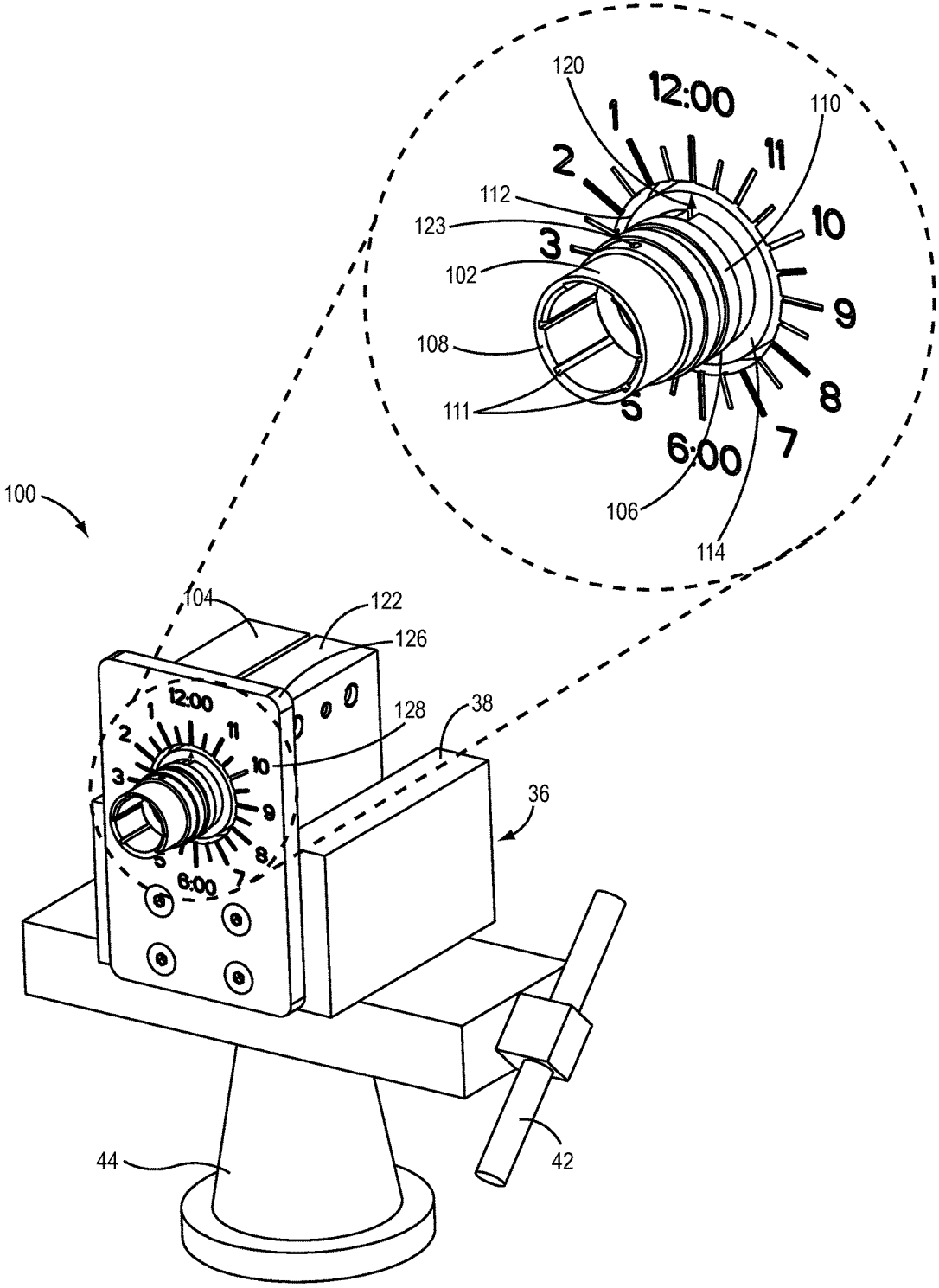
FIGS. 3A and 3B are isometric views of a cable connector clocking assembly having a socket adapter sub-assembly and an adapter holder sub-assembly according to an embodiment.
Figure 3B:
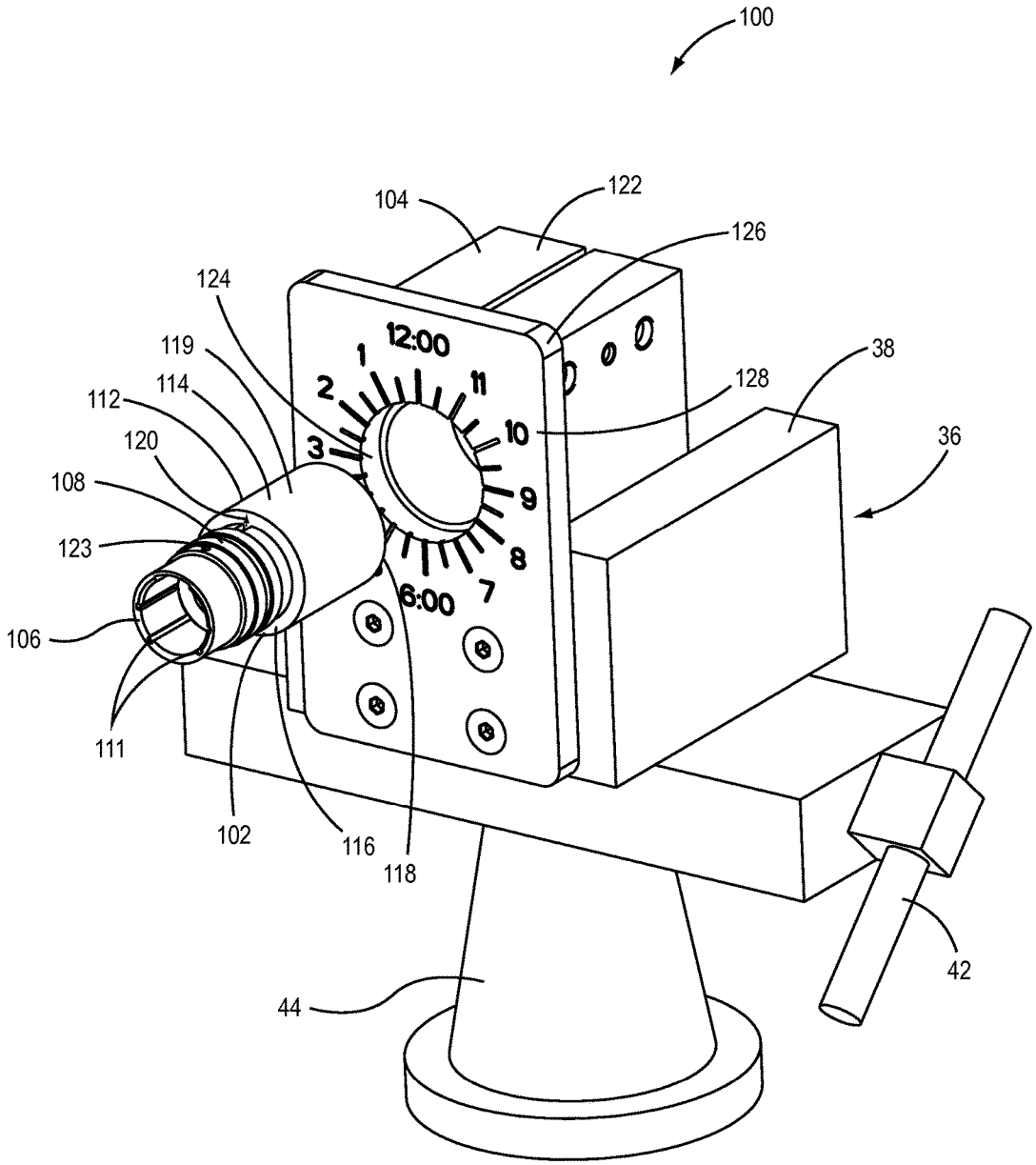

Embodiments include a cable connector clocking assembly for clocking and torqueing a cable connector, and related components, systems, and methods. Referring now to FIGS. 3A and 3B, a clocking assembly 100 has a socket adapter sub-assembly 102 configured to be mounted in an adapter holder sub-assembly 104. The socket adapter sub-assembly 102 includes a socket portion 106 having a first end 108 configured to be connected to a cable connector 12, and a second end 110. The socket portion 106 also includes key portions 111 that are complementary to key portions of a cable connector, such as key portions 20 of the cable connector 12 of FIGS. 1A-1D. The socket adapter sub-assembly 102 also includes an adapter portion 112 having a generally cylindrical body portion 114 having a first end 116 and a second end 118. The first end 116 of the cylindrical body portion 114 is connected to the second end 110 of the socket portion 106. The adapter portion 112 also has at least one indicium 120 (e.g., a pointer) configured to indicate a clock angle of the cable connector 12 when the cable connector 12 is connected to the socket portion 106. The indicium 120 is proximate to the first end 116 of the cylindrical body portion 114.

The adapter holder sub-assembly 104 of the clocking assembly 100 comprises a clamp portion 122 adapted to receive the adapter portion 112 of the socket adapter sub-assembly 102, and a face portion 126. The face portion 126 of the adapter holder sub-assembly has a plurality of indicia 128 (e.g., clock angle indicators) representative of different clock angles. In this embodiment, the clock angles indicated by the plurality of indicia 128 are reversed, i.e., arranged counter-clockwise, because the clock angle is determined based on an end view of the cable connector 12 (not shown). As will be shown in FIGS. 4A and 4B below, because the end of the cable connector 12 (not shown) is facing away from a user when using the clocking assembly 100 to clock the cable connector 12 (not shown), the clock angles of the indicia 128 are arranged in a counter-clockwise fashion in order to align with the corresponding clock angles of the cable connector 12 (not shown).

When the clamp portion 122 is in an unclamped configuration, the socket adapter sub-assembly 102 can be rotated to align the indicium 120 (i.e., the pointer) of the adapter portion with one of the indicia 128 (i.e., a specific clock angle) of the face portion 126. In this manner, the entire socket adapter sub-assembly 102, which includes the socket portion 106, can be accurately rotated to a desired clock angle. When the clamp portion 122 is in a clamped configuration, the socket adapter sub-assembly 102 is securely retained in the clamp portion at the desired clock angle.

One advantage of this arrangement is that the socket portion 106 can be accurately and securely positioned at any number of specific clock angles. By aligning and securing the indicium 120 of the socket adapter sub-assembly 102 to one of the indicia 128 of the adapter holder sub-assembly 104 corresponding to a desired clock angle of the connector assembly 10, it is possible to secure the cable connector 12 to the cable 14, e.g., by torqueing, at a desired clock angle with increased precision and with fewer errors and defects. In addition, it is also possible to inspect the clock angle of the finished connector assembly 10 before the connector assembly 10 is removed from the socket portion 106 of the clocking assembly 100. By inspecting the alignment of the indicium 120, 128 of the socket adapter sub-assembly 102 and the adapter holder sub-assembly 104, a user can quickly and accurately determine if connecting the cable connector 12 to the cable 14, e.g., during torqueing, caused any slippage in the clock angle or other defects without the need for a separate inspection device or process.

Figure 4A:
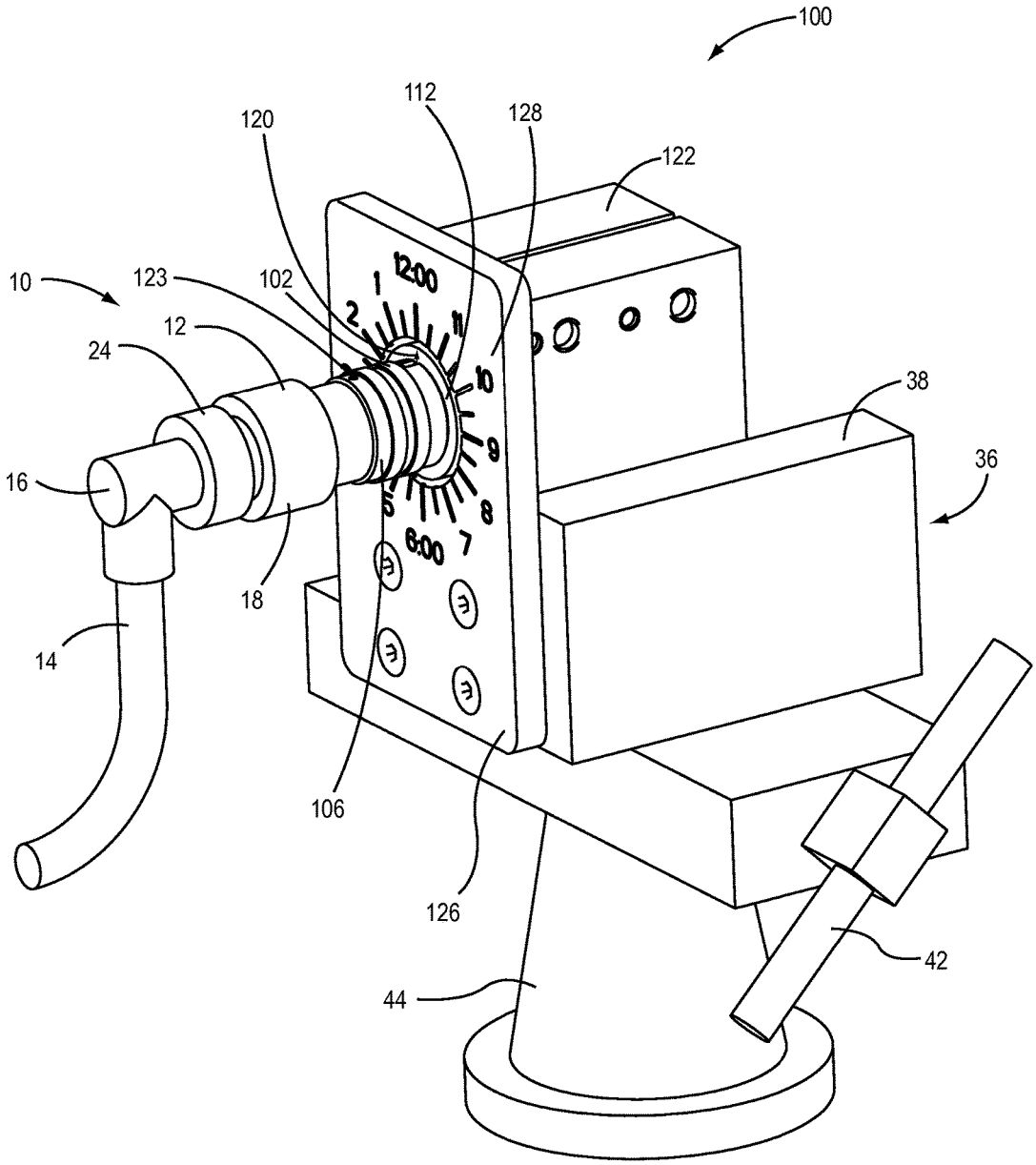
FIGS. 4A and 4B are isometric views of a method of clocking a cable connector assembly according to an embodiment.
Figure 4B:
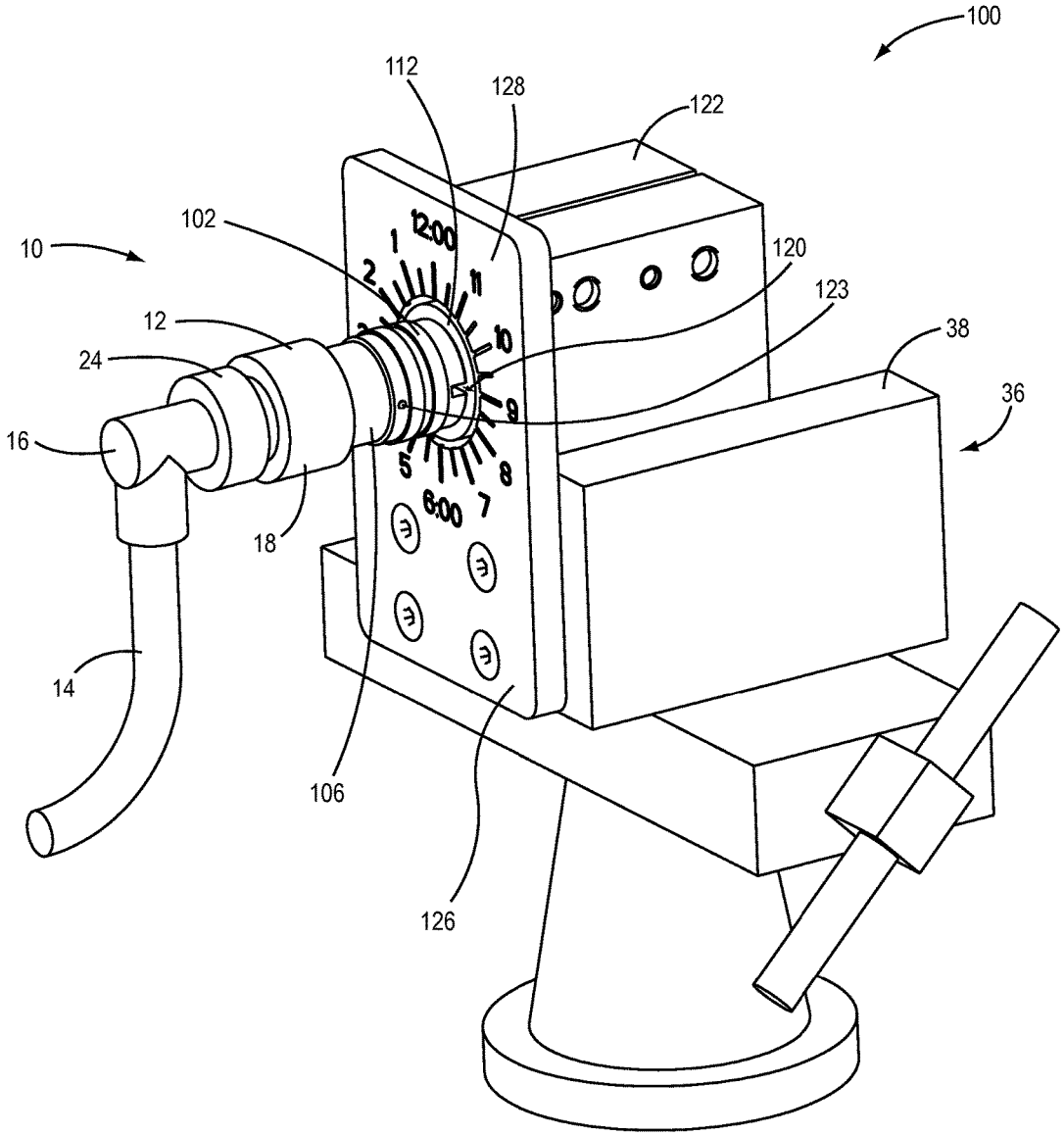

Referring now to FIGS. 4A and 4B, it can be seen that, when the cable connector 12 of the connector assembly 10 is mated with the socket portion 106 of the socket adapter sub-assembly 102, the pointer 120 of the socket adapter sub-assembly 102 is pointed to a precise clock angle indicated by clock angle indicator 128 on the adapter holder sub-assembly 104. For example, in FIG. 4A, the pointer 120 is precisely aligned with a 12:00 clock angle, as indicated by the clock angle indicator 128 of the adapter holder sub-assembly 104. As shown by FIG. 4B as well, it can be seen that the pointer 120 can be accurately rotated to any desired clock angle with high precision.

In the embodiment shown by FIGS. 4A and 4B, when backshell 24 of the connector assembly 10 is tightened, or torqued, the larger circumference of the adapter portion 112 of the socket adapter sub-assembly 102 is less likely to slip within the clamp portion 122 of the adapter holder sub-assembly 104, because a clamp interior 124 (not shown) is able to engage with the relatively large surface area of the cylindrical body portion 114. In addition, in the event that the socket adapter sub-assembly 102 does rotate within the adapter holder sub-assembly 104 when torqueing backshell 24, this defect can be easily detected and corrected while the connector assembly 10 is still mounted to the clocking assembly 100, because the pointer 120 will be misaligned with the predetermined clock angle indicated by the clock angle indicator 128 of the adapter holder sub-assembly 104.

Figure 1A:
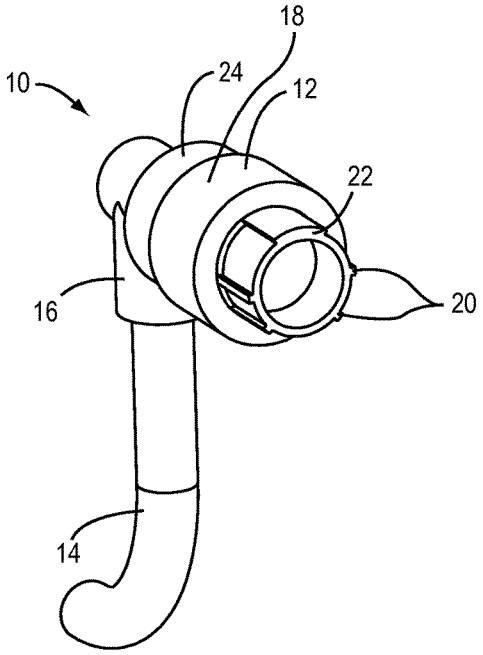
FIG. 1A PRIOR ART
FIGS. 1A-1D are isometric and front views of cable connector assemblies arranged at different clock angles, according to the prior art.
Figure 1B:
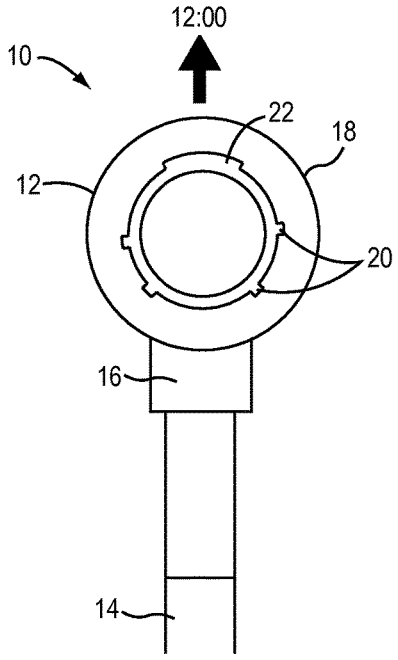
FIG. 1B PRIOR ART
Figure 1C:
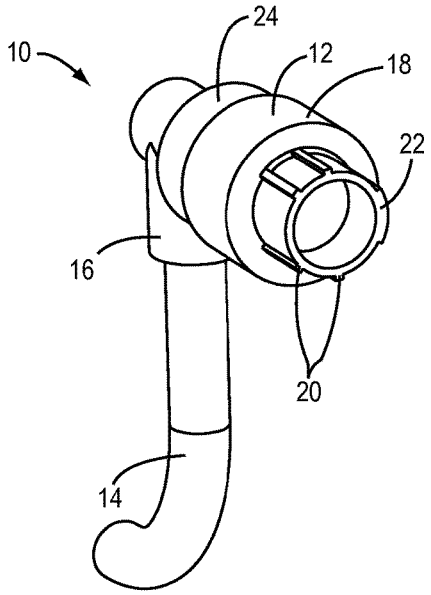
FIG. 1C PRIOR ART
Figure 1D:
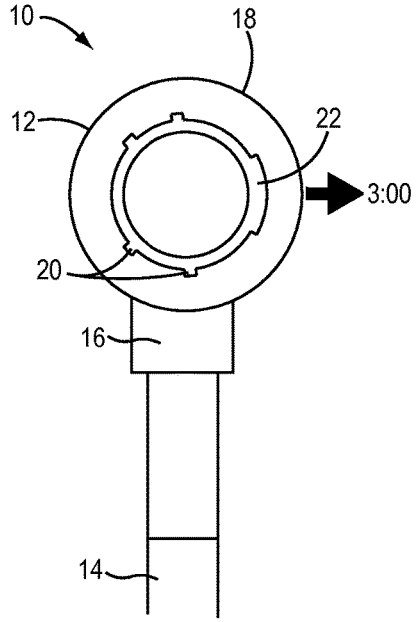
FIG. 1D PRIOR ART
Figure 2A:
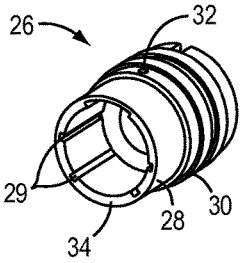
FIG. 2A PRIOR ART
FIGS. 2A-2C are isometric views of a socket and vice assembly for clocking a cable connector assembly according to the prior art.
Figure 2B:
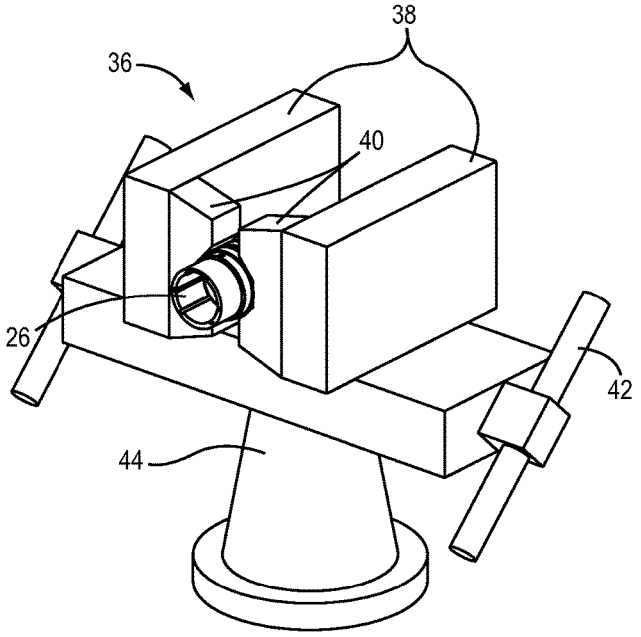
FIG. 2B PRIOR ART
Figure 2C:
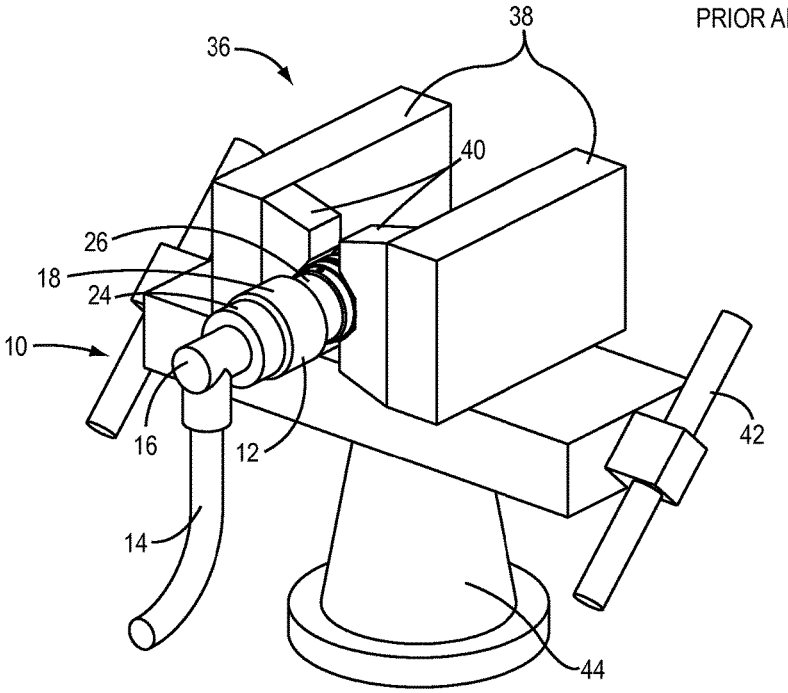
FIG. 2C PRIOR ART

In contrast with the conventional arrangement of FIGS. 2A-2C, it can be seen that the connector clocking assembly 100 addresses many of the drawbacks associated with conventional methods of assembling a connector assembly 10. For example, it is difficult to align the clocking bubble 32 of the conventional socket 26 of FIGS. 2A-2C to a precise clock angle within the jaws 40 of vice clamp 36. However, as discussed above with respect to FIGS. 4A and 4B, the socket adapter sub-assembly 102 of clocking assembly 100 has a clear and the distinct indicium 120 that is configured to precisely align with one of a number of the indicia 128 of the adapter holder sub-assembly 104.

In addition, the circumference and diameter of the grip surface 30 of socket 26 of FIGS. 2A-2C is relatively small, making it relatively easy for the socket 26 to rotationally slip within jaws 40 when the backshell 24 is torqued during assembly of the connector assembly 10. In contrast, as discussed above with respect to FIGS. 4A and 4B, the cylindrical body portion 114 of the socket adapter sub-assembly 102 has a relatively large cylindrical surface 119 that is configured to engage with the complementary clamp interior 124 of the clamp portion 122 of the adapter holder sub-assembly. This increase in diameter and circumference of the cylindrical body portion 114 means that it is more difficult for the cylindrical body portion 114 to slip within the clamp portion 122 when the clamp portion 122 is in the clamped configuration.

It should be understood that the socket adapter sub-assembly 102 may include additional indicia, such as an identifier for the socket and/or connector type for the socket adapter sub-assembly 102. Conventional sockets 26 (see FIGS. 2A and 2B) may include a model number marked on a back end of the socket 26. Thus, when a conventional socket is adapted for use as a socket portion 106 of a socket adapter sub-assembly 102, the model number is not visible. Thus, it may be desirable to provide additional indicia elsewhere on the socket adapter sub-assembly 102, in order to permit easy identification of the socket portion 106 used with the socket adapter sub-assembly 102.

Figure 5A:
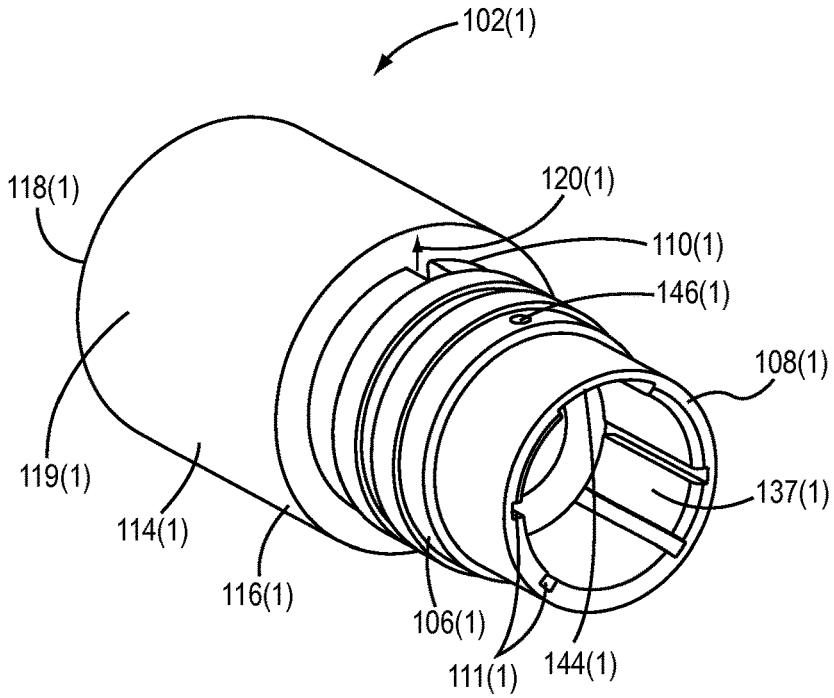
FIGS. 5A-5E are isometric, exploded, and cross sectional views of the socket adapter sub-assembly of FIGS. 3A-4B, and detailed isometric and end views of the socket portion of the socket adapter sub-assembly.
Figure 5B:
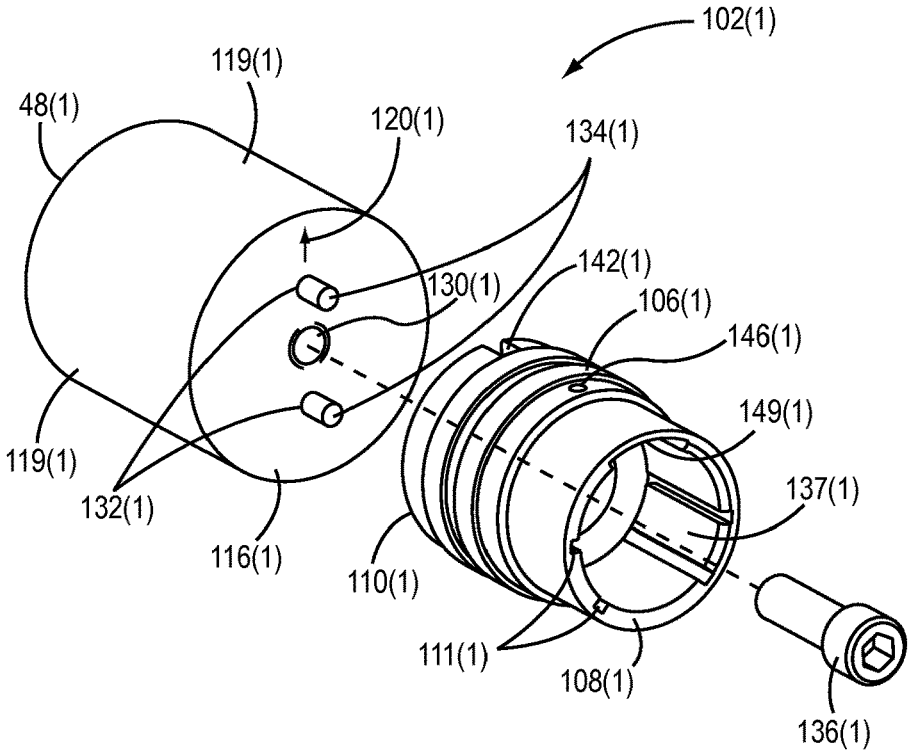
Figure 5C:
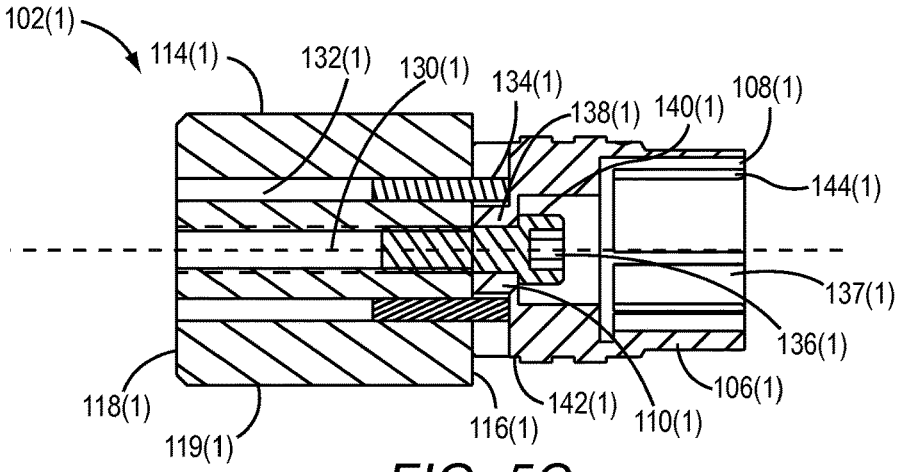
Figure 5D:
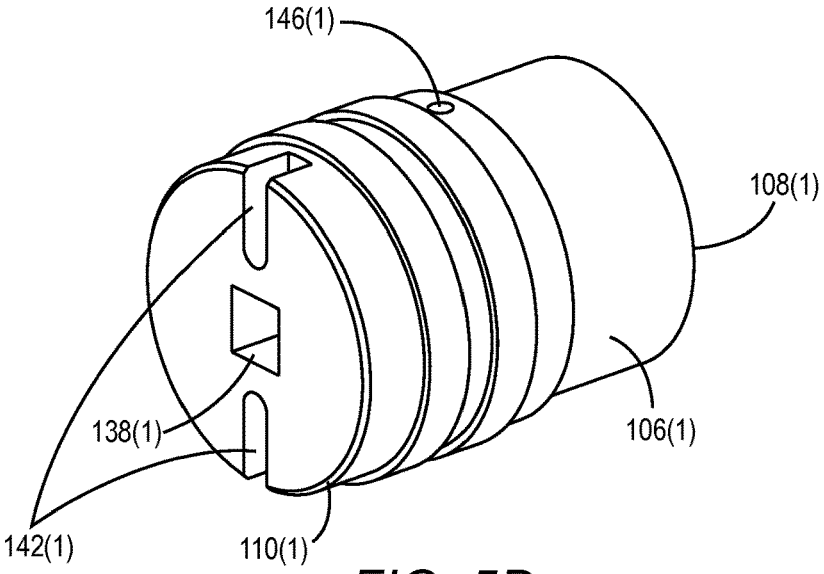
Figure 5E:
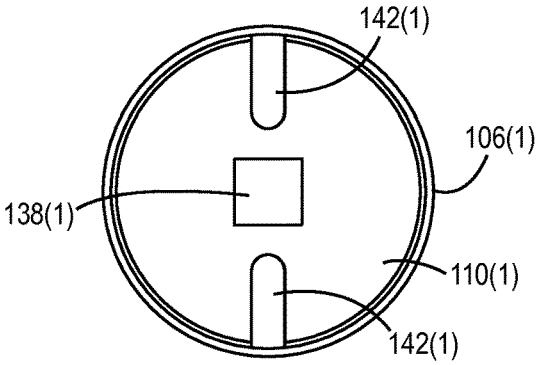
Figure 6A:
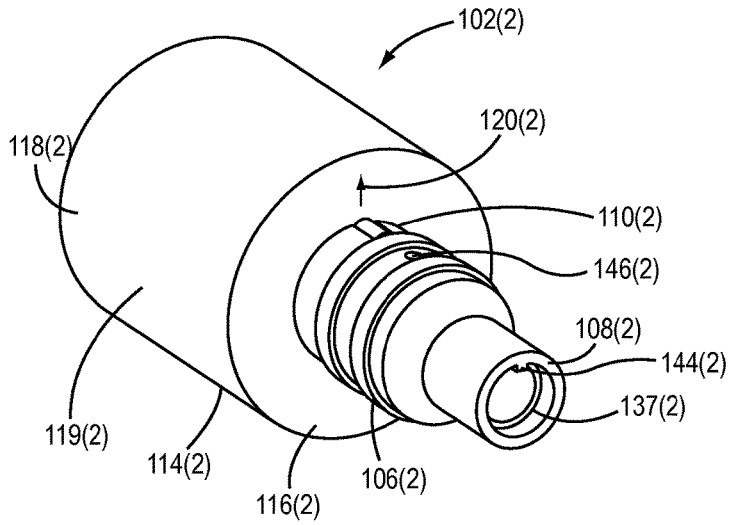
FIGS. 6A-6E are isometric, exploded, and cross sectional views of a socket adapter sub-assembly according to an alternative embodiment, and detailed isometric and end views of the socket portion of the socket adapter sub-assembly.
Figure 6B:
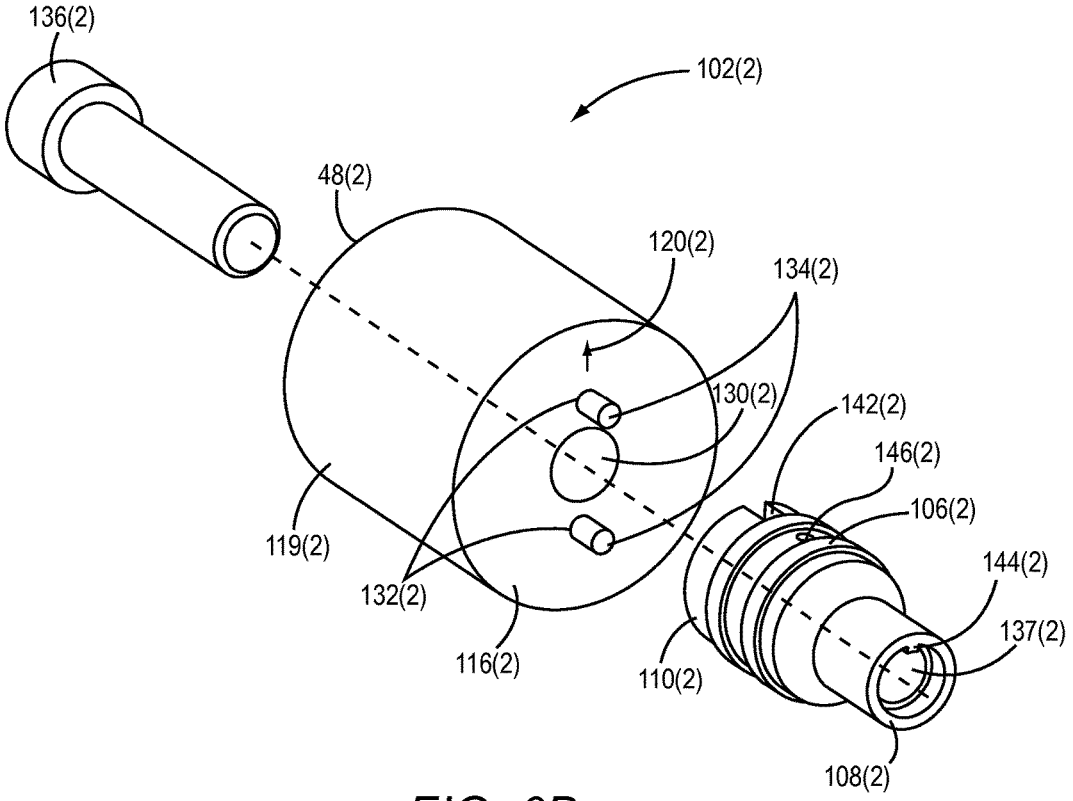
Figure 6C:
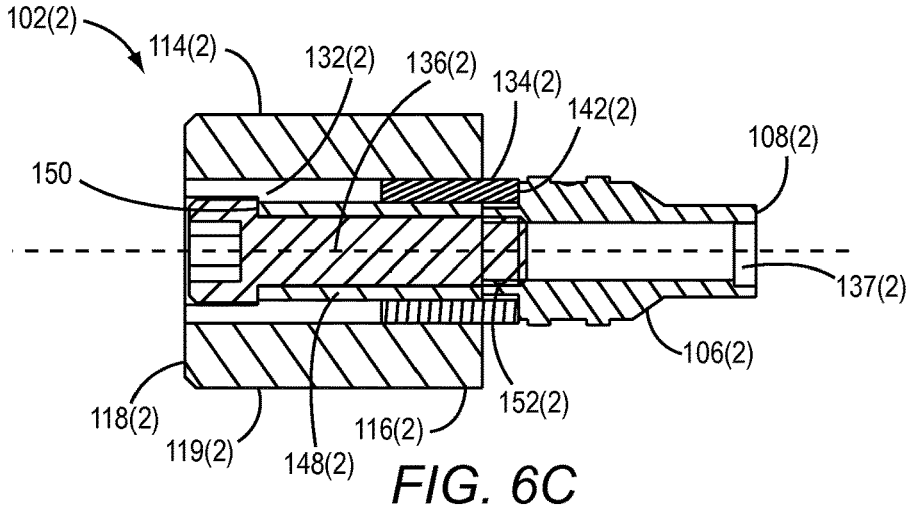
Figure 6D:
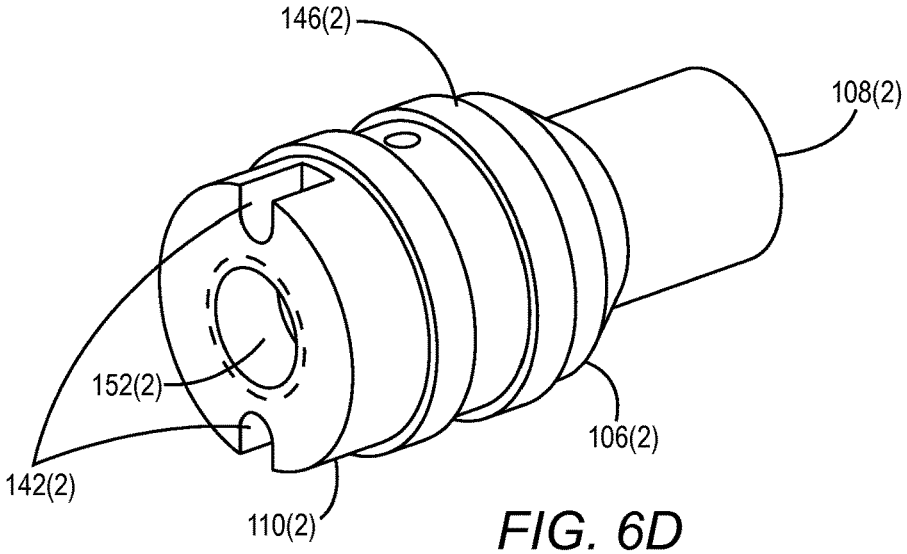
Figure 6E:
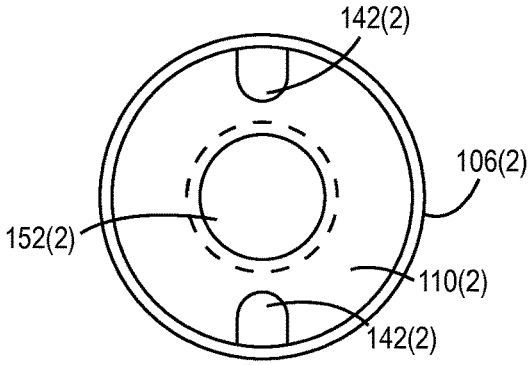

The clocking assembly 100 may be assembled in a number of different ways. In this regard, FIGS. 5A through 5E illustrate detailed views of a socket adapter sub-assembly 102(1) and its components, according to one embodiment. In this embodiment, a cylindrical body portion 114(1) has a central threaded bore 130(1) extending into the cylindrical body portion 114(1). The cylindrical body portion 114(1) also includes a pair of guide pin openings 132(1), each containing a guide pin 134(1), such as a dowel pin, that extends out from a first end 116(1) of an adapter portion 112(1) of the socket adapter sub-assembly 102(1). It should be understood that other types of guide pins or other guide features may be used as well. In this example, a threaded bolt 136(1) or other threaded fastener is guided through a socket interior 137(1) and extends through a central opening 138(1) of a socket portion 106(1) to engage with the threaded bore 130(1) of the adapter portion 112(1) (see FIG. 5C). As also shown by FIG. 5C, the bolt 136(1) abuts an internal stop 140(1), thereby securely retaining the socket portion 106(1) against the adapter portion 112(1). To maintain alignment between the key portions 144(1) and a clocking bubble 146(1) of the socket portion 106(1) and a pointer 120(1) of the adapter portion 112(1), the socket portion 106(1) has a pair of recesses 142(1) each configured to receive one of the guide pins 134(1) extending from the adapter portion 112(1). In this manner, when the bolt 136(1) is tightened to secure the socket portion 106(1) against the adapter portion 112(1), the guide pins 134(1) engage the recesses 142(1) to prevent any rotational movement of the socket portion 106(1) with respect to the adapter portion 112(1). As shown by FIGS. 5D and 5E, the recesses 142(1) in this example are machined grooves, but it should be understood that other types of recesses, such as holes, may be used. In this example, the socket portion 106(1) may be a modified version of conventional socket 26 of FIGS. 2A and 2B, with the only necessary modifications being the addition of the recesses 142(1). In this manner, existing sockets 26 can be modified to be used as the socket portions 106 for a clocking assembly, such as clocking assembly 100, with minimal time and expense.

Some conventional sockets having smaller diameters may not be suitable for use in the arrangement of FIGS. 5A through 5E, because the socket interior 137(2) may be too small to accommodate an appropriately sized bolt 136(2). In this regard, FIGS. 6A through 6E illustrate a socket adapter sub-assembly 102(2) according to another embodiment. In this example, an adapter portion 112(2) has a central bore 148(2) with an internal stop 150(2), such that the bolt 136(2) can be inserted through the adapter portion 112(2) from a second end 118(2) of the adapter portion 112(2). In this example, a socket portion 106(2) may be modified to include a threaded opening 152(2), as well as the recesses 142(2). Thus, in this embodiment, the threaded bolt 136(2) instead engages with the threaded opening 152(2) of the socket portion 106(2), thereby retaining the adapter portion 112(2) against the socket portion 106(2).

In the embodiments of FIGS. 5A-6E, the adapter portions 112(1) and 112(2) have a common diameter. This permits different socket adapter sub-assemblies 102 with different types of socket portions 106 to be quickly and efficiently replaced within a common adapter holder sub-assembly 104. In one embodiment, a plurality of different socket adapter sub-assemblies 102, all having adapter portions 112 with a common diameter, may be provided as part of a set or kit, to be used with a single adapter holder sub-assembly 104. One advantage of this arrangement is that the adapter holder sub-assembly 104 could be fixed in place within the vice clamp 36, such that only the clamp portion 122 is required to be tightened or loosened in order to secure or replace one of the socket adapter sub-assemblies 102. In addition, in some embodiments, the force required to secure the clamp portion 122 is significantly less than the force required to secure the vice clamp 36, thereby subjecting a user's hands and wrists to less stress and discomfort when changing out different socket adapter sub-assemblies 102.

Figure 7:
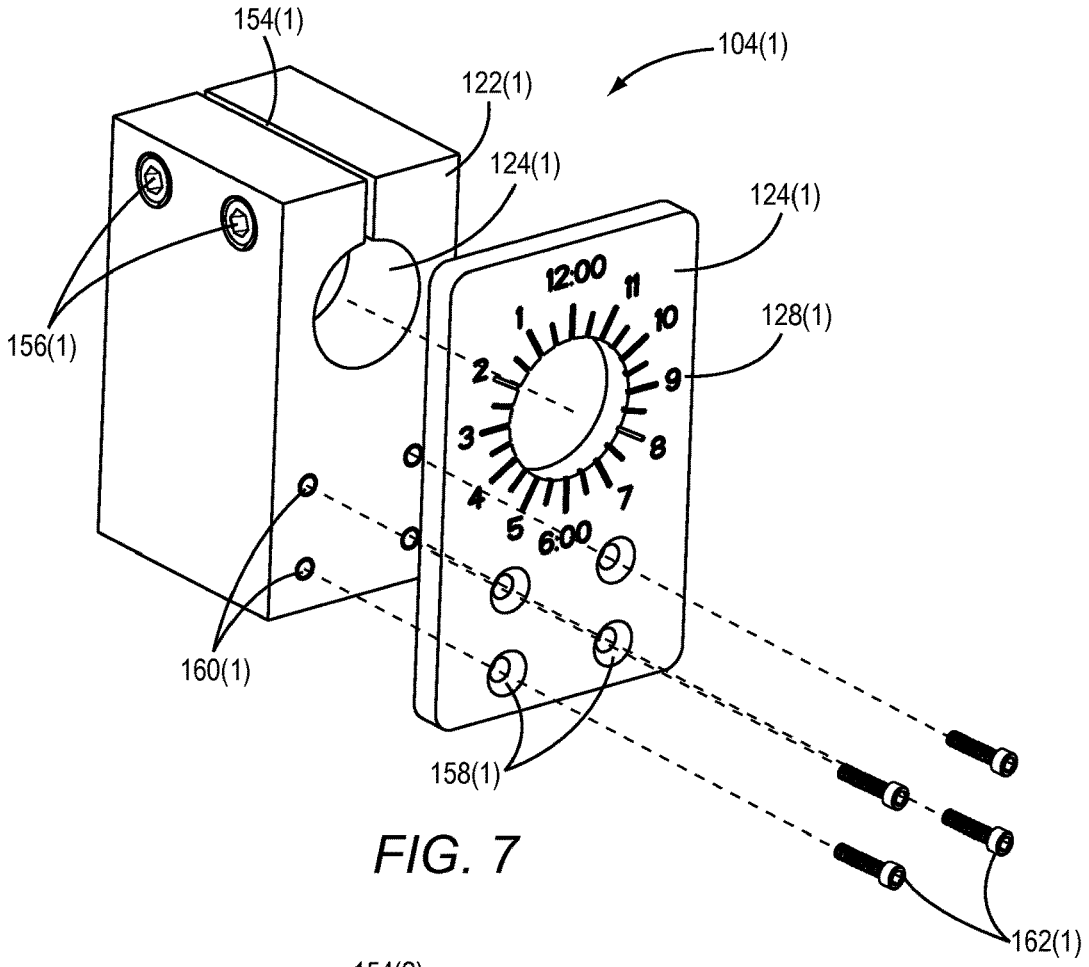
FIG. 7 is an isometric exploded view of the adapter holder sub-assembly of FIGS. 3A-4B.

It should be understood that the adapter holder sub-assembly 104 may also have different configurations and modifications. In this regard, FIG. 7 illustrates an exploded isometric view of an adapter holder sub-assembly 104(1), which is similar to the adapter holder sub-assembly 104 of FIGS. 3A through 4B. In this embodiment, a clamp portion 122(1) includes a clamp interior 124(1) with a slit 154(1) extending along the top end of the clamp portion 122(1). In this example, a pair of threaded clamp bolts 156(1) extends into the clamp portion 122(1) and spans the slit 154(1) and pulls the sides of the clamp interior 124(1) together, thereby causing the clamp interior 124(1) to function as an integral clamp mechanism around the socket adapter sub-assembly 102(1). In this example, a separate face portion 126(1) has a number of openings 158(1) corresponding to complementary openings 160(1) on the clamp portion 122(1). A number of bolts 162(1) or other fasteners are configured to secure the face portion 126(1) to the clamp portion 122(1) in this embodiment. In this embodiment, bolts 162(1) are threaded bolts and openings 160(1) are threaded openings, but it should be understood that other types of fastening methods may be used. One advantage of this arrangement is that the face portion 126(1) may be formed of a different material than the clamp portion 122(1), for example to reduce expenses or to more easily print or etch the clock angle indicators 128(1) onto the face portion 126(1).

Figure 8:
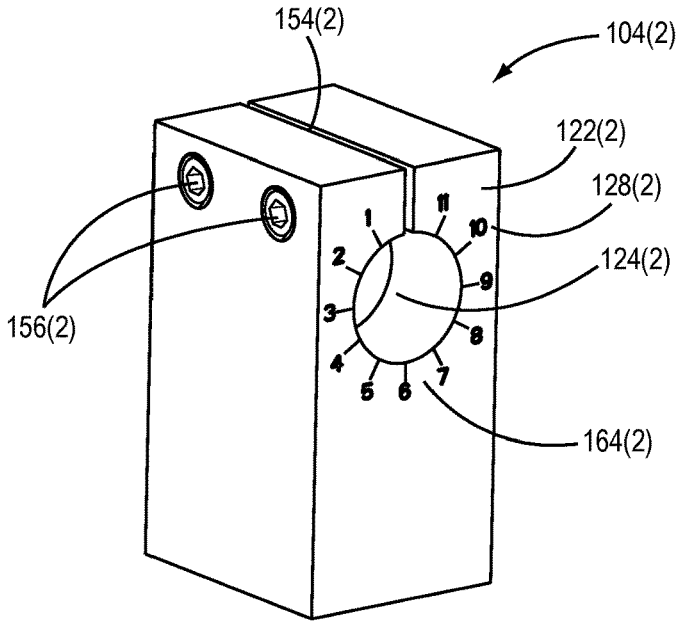
FIG. 8 is an isometric view of an adapter holder sub-assembly according to an alternative embodiment.

Referring now to FIG. 8, it is also possible to form an adapter holder sub-assembly 104(2) as an integral component. In this embodiment, the clock angle indicators 128(2) may be printed or etched directly onto a face of a unitary clamp portion 122(2). One advantage of this arrangement is a reduction in the number of parts required for the adapter holder sub-assembly 104(2).

Those skilled in the art will recognize improvements and modifications to the preferred embodiments of the disclosure. All such improvements and modifications are considered within the scope of the concepts disclosed herein and the claims that follow.

What is claimed is:

1. A clocking assembly for cable connectors comprising:

at least one socket adapter sub-assembly comprising:

a socket portion having a first end and a second end, wherein the first end includes a first key portion configured to receive a complementary second key portion of a cable connector to prevent relative rotation between the socket portion and the cable connector;

an adapter portion comprising:

a generally cylindrical body portion having a first end and a second end, wherein the second end of the socket portion is connected to the first end of the cylindrical body portion to prevent relative rotation between the socket portion and the adapter portion; and at least one indicium proximate to the first end of the cylindrical body portion configured to indicate a clock angle of the cable connector when the cable connector is connected to the socket portion; and an adapter holder sub-assembly comprising:

at least one clamp portion configured to receive the adapter portion of the socket adapter sub-assembly therein; and a face portion having a plurality of indicia indicative of different clock angles, wherein:

the clamp portion has an unclamped configuration, in which the socket adapter sub-assembly is rotatable to align the indicium of the adapter portion with an indicium of the plurality of indicia of the face portion; and the clamp portion has a clamped configuration, in which the socket adapter sub-assembly is retained with the indicium of the adapter portion aligned with the indicium of the plurality of indicia of the face portion.

2. The clocking assembly of claim 1, wherein the cylindrical body portion of the socket adapter sub-assembly has a diameter larger than a diameter of the socket adapter portion.

3. The clocking assembly of claim 1, wherein the socket adapter sub-assembly further comprises at least one threaded fastener securing the socket portion to the adapter portion.

4. The clocking assembly of claim 3, wherein the at least one threaded fastener extends through an opening in the cylindrical body portion of the adapter portion and is connected to a complementary threaded opening in the socket portion.

5. The clocking assembly of claim 3, wherein the at least one threaded fastener extends through an opening in the socket portion and is connected to a complementary threaded opening in the cylindrical body of the adapter portion.

6. The clocking assembly of claim 3, wherein the socket adapter sub-assembly comprises at least one guide pin extending from one of the socket portion and the adapter portion, the guide pin being configured to mate with a complementary opening in the other of the socket portion and the adapter portion.

7. The clocking assembly of claim 1, wherein the socket portion and the adapter portion of the socket adapter sub-assembly are formed as a unitary component.

8. The clocking assembly of claim 1, wherein the at least one socket adapter sub-assembly is a plurality of socket adapter sub-assemblies, wherein the socket portion each socket adapter sub-assembly is configured to be connected to a unique type of cable connector.

9. The clocking assembly of claim 1, wherein the face portion of the adapter holder sub-assembly comprises a face plate connected to the clamp portion.

10. The clocking assembly of claim 1, wherein the face portion of the adapter holder sub-assembly is an external surface of the clamp portion of the adapter holder sub-assembly.

11. The clocking assembly of claim 10, wherein the indicia of the face portion of the adapter holder sub-assembly are etched into the external surface of the clamp portion of the adapter holder sub-assembly.

12. The clocking assembly of claim 10, wherein the indicia of the face portion of the adapter holder sub-assembly are printed on the external surface of the clamp portion of the adapter holder sub-assembly.

13. A socket adapter assembly for a clocking assembly comprising:

a socket portion having a first end and a second end, the first end includes a first key portion configured to receive a complementary second key portion of a cable connector to prevent relative rotation between the socket portion and the cable connector; and an adapter portion comprising:

a generally cylindrical body portion having a first end and a second end, wherein the second end of the socket portion is connected to the first end of the cylindrical body portion to prevent relative rotation between the socket portion and the adapter portion; and at least one indicium proximate to the first end of the cylindrical body portion configured to indicate a clock angle of a cable connector when the cable connector is connected to the socket portion.

14. The socket adapter assembly of claim 13, wherein the cylindrical body portion of the socket adapter sub-assembly has a diameter larger than a diameter of the socket adapter portion.

15. The socket adapter assembly of claim 13, wherein the socket adapter sub-assembly further comprises at least one threaded fastener securing the socket portion to the adapter portion.

16. The socket adapter assembly of claim 15, wherein the at least one threaded fastener extends through an opening in the cylindrical body of the adapter portion and is connected to a complementary threaded opening in the socket portion.

17. The socket adapter assembly of claim 15, wherein the at least one threaded fastener extends through an opening in the socket portion and is connected to a complementary threaded opening in the cylindrical body of the adapter portion.

18. The socket adapter assembly of claim 17, wherein the socket adapter sub-assembly comprises at least one guide pin extending from one of the socket portion and the adapter portion, the guide pin being configured to mate with a complementary opening in the other of the socket portion and the adapter portion.

19. The socket adapter assembly of claim 13, wherein the socket portion and the adapter portion of the socket adapter sub-assembly are formed as a unitary component.

* * * * *